US009538860B2

(12) United States Patent
Brej et al.

(10) Patent No.: US 9,538,860 B2
(45) Date of Patent: Jan. 10, 2017

(54) SELECTIVELY LOCKING MERCHANDISING MEMBER

(71) Applicants: Thaddeus Brej, Rocky River, OH (US); Shane Obitts, Elyria, OH (US); Gregory M. Bird, Solon, OH (US)

(72) Inventors: Thaddeus Brej, Rocky River, OH (US); Shane Obitts, Elyria, OH (US); Gregory M. Bird, Solon, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 0 days.

(21) Appl. No.: 14/867,555

(22) Filed: Sep. 28, 2015

(65) Prior Publication Data

US 2016/0088935 A1 Mar. 31, 2016

Related U.S. Application Data

(60) Provisional application No. 62/055,985, filed on Sep. 26, 2014.

(51) Int. Cl.
*A47F 1/12* (2006.01)
*A47F 5/00* (2006.01)

(52) U.S. Cl.
CPC ..... *A47F 5/005* (2013.01); *A47F 1/126* (2013.01)

(58) Field of Classification Search
CPC ... A47B 47/0091; A47B 57/58; A47B 57/583; A47B 57/585; A47B 57/586; A47F 1/00; A47F 1/04; A47F 1/12; A47F 1/121; A47F 1/123; A47F 1/125; A47F 1/126; A47F 1/128; A47F 7/0007; A47F 7/0035; A47F 13/00
USPC ..... 211/59.2, 59.3, 126.6
See application file for complete search history.

(56) References Cited

U.S. PATENT DOCUMENTS

| | | | | |
|---|---|---|---|---|
| 4,905,847 | A | 3/1990 | Hanson | |
| 5,657,702 | A | 8/1997 | Ribeyrolles | |
| 5,884,782 | A * | 3/1999 | Dembicks | B25H 3/06 211/175 |
| 6,047,647 | A * | 4/2000 | Laraia, Jr. | A47F 5/005 108/61 |
| 6,357,606 | B1 * | 3/2002 | Henry | A47F 1/126 211/184 |
| 7,216,770 | B2 * | 5/2007 | Mueller | A47F 5/005 211/59.3 |

(Continued)

FOREIGN PATENT DOCUMENTS

| | | |
|---|---|---|
| EP | 1 514 493 B1 | 4/2007 |
| EP | 1 617 745 B1 | 8/2007 |

(Continued)

*Primary Examiner* — Joshua Rodden
(74) *Attorney, Agent, or Firm* — Fay Sharpe LLP

(57) ABSTRACT

A merchandising system can include an elongated mounting member selectively securable to an associated shelf and a cooperating member received on the mounting member. The cooperating member can extend rearwardly over the associated shelf. The cooperating member can include an elongated body having a front end, and a rear end. The elongated body can include a base portion and a divider portion protruding from the base portion. A latch can be movably mounted to the cooperating member. The latch selectively engages the elongated mounting member to retard a sliding motion of the cooperating member on the mounting member.

18 Claims, 12 Drawing Sheets

(56) References Cited

U.S. PATENT DOCUMENTS

| | | | | |
|---|---|---|---|---|
| 7,395,938 | B2 * | 7/2008 | Merit | A47F 5/005 211/184 |
| 7,641,057 | B2 * | 1/2010 | Mueller | A47F 1/126 206/221 |
| 8,177,076 | B2 * | 5/2012 | Rataiczak, III | A47F 1/126 211/59.3 |
| 8,342,340 | B2 | 1/2013 | Rataiczak, III et al. | |
| 8,627,965 | B2 | 1/2014 | Hardy | |
| 8,739,984 | B2 * | 6/2014 | Hardy | A47F 1/126 211/119.003 |
| 8,746,468 | B2 * | 6/2014 | Poulokefalos | A47F 1/126 211/59.3 |
| 8,752,717 | B2 * | 6/2014 | Bird | A47F 1/04 211/184 |
| 8,967,394 | B2 * | 3/2015 | Hardy | A47F 1/126 211/175 |
| 8,978,904 | B2 * | 3/2015 | Hardy | A47F 1/126 211/184 |
| 9,173,505 | B2 | 11/2015 | Hardy | |
| 9,259,102 | B2 * | 2/2016 | Hardy | A47F 1/04 |
| 2002/0170866 | A1 * | 11/2002 | Johnson | A47F 1/126 211/59.3 |
| 2007/0138114 | A1 * | 6/2007 | Dumontet | A47F 1/126 211/59.3 |
| 2012/0006773 | A1 | 1/2012 | Mueller et al. | |
| 2014/0217042 | A1 | 8/2014 | Hardy | |
| 2014/0299560 | A1 * | 10/2014 | Kim | A47F 1/126 211/59.2 |
| 2014/0326690 | A1 | 11/2014 | Hardy | |
| 2014/0326691 | A1 | 11/2014 | Hardy | |
| 2015/0208830 | A1 * | 7/2015 | Hardy | A47F 1/126 211/59.3 |
| 2015/0359358 | A1 * | 12/2015 | Miller, Jr. | A47F 1/12 211/59.2 |
| 2016/0081491 | A1 * | 3/2016 | Hardy | A47F 1/12 211/59.2 |
| 2016/0088935 | A1 * | 3/2016 | Brej | A47F 13/00 211/126.6 |

FOREIGN PATENT DOCUMENTS

| | | | |
|---|---|---|---|
| WO | WO 01/97660 | A1 | 12/2001 |
| WO | WO 2007/073294 | A1 | 6/2007 |

* cited by examiner

SELECTIVELY LOCKING MERCHANDISING MEMBER

This application claims the benefit of Provisional Application Ser. No. 62/055,985 which was filed on Sep. 26, 2014. The entire content of that application is incorporated hereinto by reference.

BACKGROUND

The present disclosure pertains to a merchandising system. More specifically, the disclosure relates to a base and divider assembly employed in a forward feeding display merchandising system for storing and displaying merchandise of a variety of shapes and sizes and automatically delivering the merchandise to the front of a shelf. More particularly, the disclosure pertains to a cooperating member, such as a divider or track which can be selectively locked to a front rail or mounting member of the merchandising system.

Shelving is used extensively for stocking and storing products or merchandise in a variety of stores, such as grocery stores, drug stores and mass merchandisers, such as Walmart, Kmart and the like. Most consumer product stores contain fixed shelving which is arranged back to back between aisleways, on which shelving merchandise is stocked. It is desirable for merchandise to be displayed at the front edge of the shelf so that the customer can see the merchandise and be induced to purchase such merchandise. In such stores, if the shelves are not positioned at eye level, it is difficult for the customer to see the items being displayed, if the items are not located adjacent the front edge of the shelf. Also, fixed shelves make it difficult to rotate product, i.e., move the older stock to the front of the shelf and position newer stock behind the older stock. Rotating products is an important consideration if the goods are perishable or subject to becoming stale (cigarettes, fruit juices, dairy products and the like fall into this category). It is important for such articles that they be removed following a first in, first out system to maintain freshness.

Forward feed devices are employed to automatically move an item forward on a shelf, as the item before it in a column of merchandise is removed from the shelf. These devices generally fall into three categories. The first category pertains to inclined tracks which rely on gravity to feed, slide, or roll products forward on the shelf. Gravity feeding, however, may be unpredictable in that various materials or packages slide more easily than others because of different weights and frictional interfaces between the products and the track. The second category employs conveyor belts which still use gravity to effect forward movement. These devices are typically cumbersome, expensive and complicated due to the need to properly tension the track and the conveyor belts. The third category uses spring biased pusher paddles to feed the product forward. Such paddle based forward feed devices have become very popular and have been found useful for a variety of merchandise.

In the third category, separate dividers and tracks containing pusher paddles are usually employed, along with end dividers to separate the merchandise into columns. It has been considered advantageous to provide an integrated track and divider system because such an integrated track and divider makes assembly of the merchandising system on a shelf easier for store personnel as there are less components to handle. However, an integrated track and divider is disadvantageous from the perspective that the divider cannot be removed from the track should that become necessary. In some circumstances, such as for wide products, a drop in track is desired so that two pusher paddles urge the merchandise forward. Currently, a separate track has to be produced for this purpose. It would be advantageous to provide a two part track and divider assembly in which the divider can be selectively separated from the track or connected thereto. In other words, it would be desirable to provide a connection structure to selectively engage the divider with the track or disengage the divider from the track as may be required in a particular merchandising environment.

It would also be desirable to selectively lock the dividers to the front rail in order to retard the sideward or lateral movement of the dividers as product is being pushed forward on the track by the spring biased pusher paddles. In other words, it would be desirable to allow the divider to selectively engage the front rail in such a way that the divider is allowed to slide sideways in relation to the front rail in one end position of a locking assembly and is retarded from such sliding movement in another end position of the locking assembly. Ideally, the divider would be movable in a lateral direction parallel to the front rail while being secured in a direction perpendicular to the front rail when a locking member is disengaged but the divider would resist movement in the lateral direction parallel to the front rail and would remain secured in a direction perpendicular to the front rail when the locking member is engaged. It may be advantageous to provide tracks with such a feature as well.

BRIEF SUMMARY OF THE DISCLOSURE

In accordance with the present disclosure, a merchandising system comprises an elongated mounting member selectively securable to an associated shelf and a cooperating member received on the mounting member, wherein the cooperating member extends rearwardly over the associated shelf. The cooperating member comprises an elongated body including a front end and a rear end, the body comprising a base portion. A latch is movably mounted to the cooperating member and selectively engages the elongated mounting member.

In one embodiment, the latch is slidably mounted to a divider portion protruding from the base portion. The latch can comprise a body including a front face comprising a gripping portion and a protrusion that may be spaced from the gripping portion. The latch planar body can include a rear face comprising a first engaging portion which cooperates with a second engaging portion located on the divider.

In one embodiment, the elongated mounting member can comprise a catch portion which cooperates with the latch. If desired, the catch portion can comprise a wall section of the mounting member and a groove defined in the wall section such that a protrusion of the latch is adapted to selectively extend into the groove. The base portion of the elongated body can include a tongue, such that the protrusion selectively engages the tongue.

If desired, the gripping portion can be spaced from the protrusion.

In one embodiment, the divider portion of the elongated body is selectively detachable from and attachable to the base portion.

In one embodiment, the elongated body base portion includes a first side edge and an opposed second side edge and wherein the divider portion is selectively attachable to one of the first and second side edges of the base portion.

If desired, the cooperating member and the latch define between them a first stop and spaced therefrom, a second stop and wherein the first and second stops limit a sliding movement of the latch in relation to the cooperating member.

According to another embodiment of the present disclosure, there is provided a merchandising system comprising an elongated mounting member including a base, a front wall, a back wall and a slot defined between the front wall and the back wall. A cooperating member includes a base, a front end and a divider portion which protrudes from the base. The front end of the cooperating member is adapted to cooperate with the mounting member. A latch member is movably mounted on the divider. The latch member includes a protrusion adapted to selectively enter the slot defined in the mounting member.

In accordance with still another embodiment of the present disclosure, there is provided a merchandising system comprising an elongated mounting member including a longitudinal axis. The mounting member includes a front wall, a back wall and a slot defined between the front wall and the back wall. A cooperating member includes an elongated body which is oriented in a direction generally transverse to the mounting member longitudinal axis. The cooperating member includes a front end portion received in the slot of the mounting member. A latch member is movably mounted to the cooperating member. The latch member includes a protrusion adapted to selectively enter the slot of the elongated mounting member so as to retard a lateral movement of the cooperating member in relation to the mounting member. When the protrusion is not located in the slot, a lateral movement of the cooperating member is permitted in relation to the mounting member.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein.

DETAILED DESCRIPTION

Figure 2:
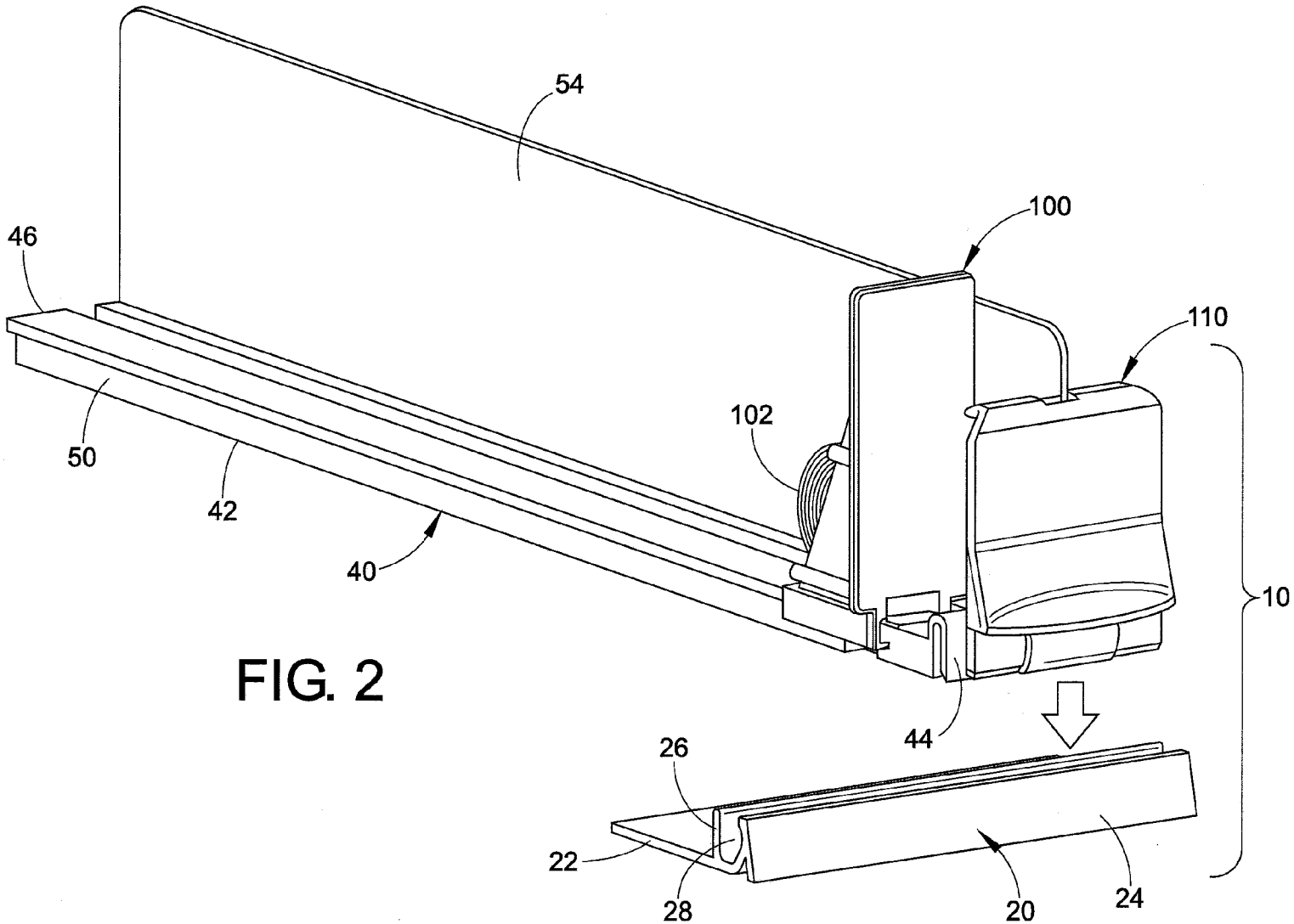
FIG. 2 is a perspective view of the cooperating member in an assembled condition exploded away from an elongated mounting member of the merchandising system illustrated in the form of a front rail.

Referring now to the drawings wherein the showings are for purposes of illustrating several embodiments of the disclosure only, FIG. 2 shows a merchandising system 10 which includes a mounting member 20 comprising a base 22, a front wall 24, a tongue or back wall 26 spaced from the front wall and a groove 28 defined between the front wall and the tongue. It should be appreciated that, in this embodiment, the tongue 26 protrudes from a top face of the base 22 and extends from one side edge to the opposed side edge of the mounting member 20. Of course, other designs are also possible. The merchandising system 10 also includes a cooperating member 40 that can be selectively connected to or mounted to the mounting member.

Figure 1:
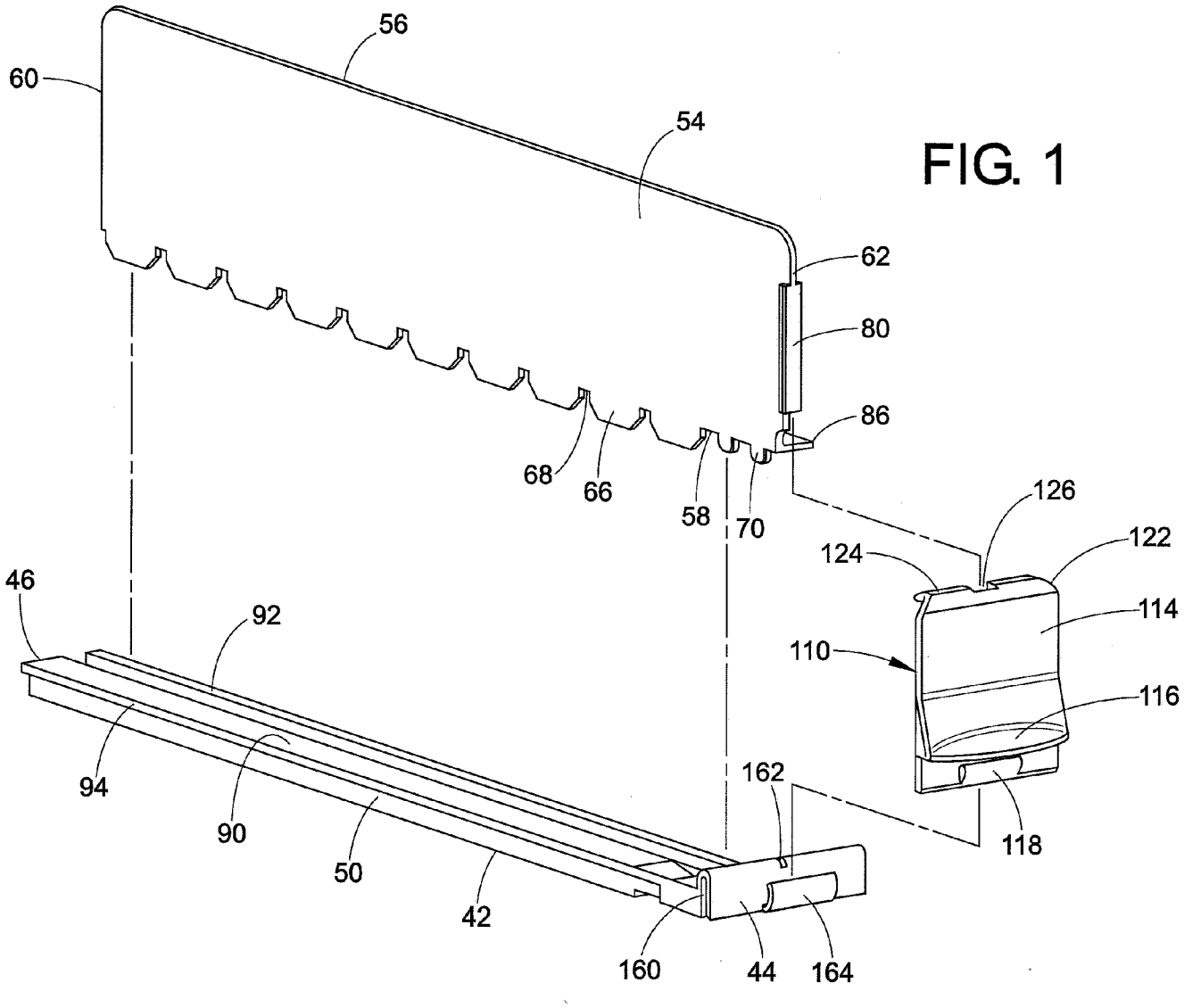
FIG. 1 is an exploded perspective view of a base and divider assembly of a merchandising system which constitutes one embodiment of a cooperating member according to the present disclosure.
Figure 4:
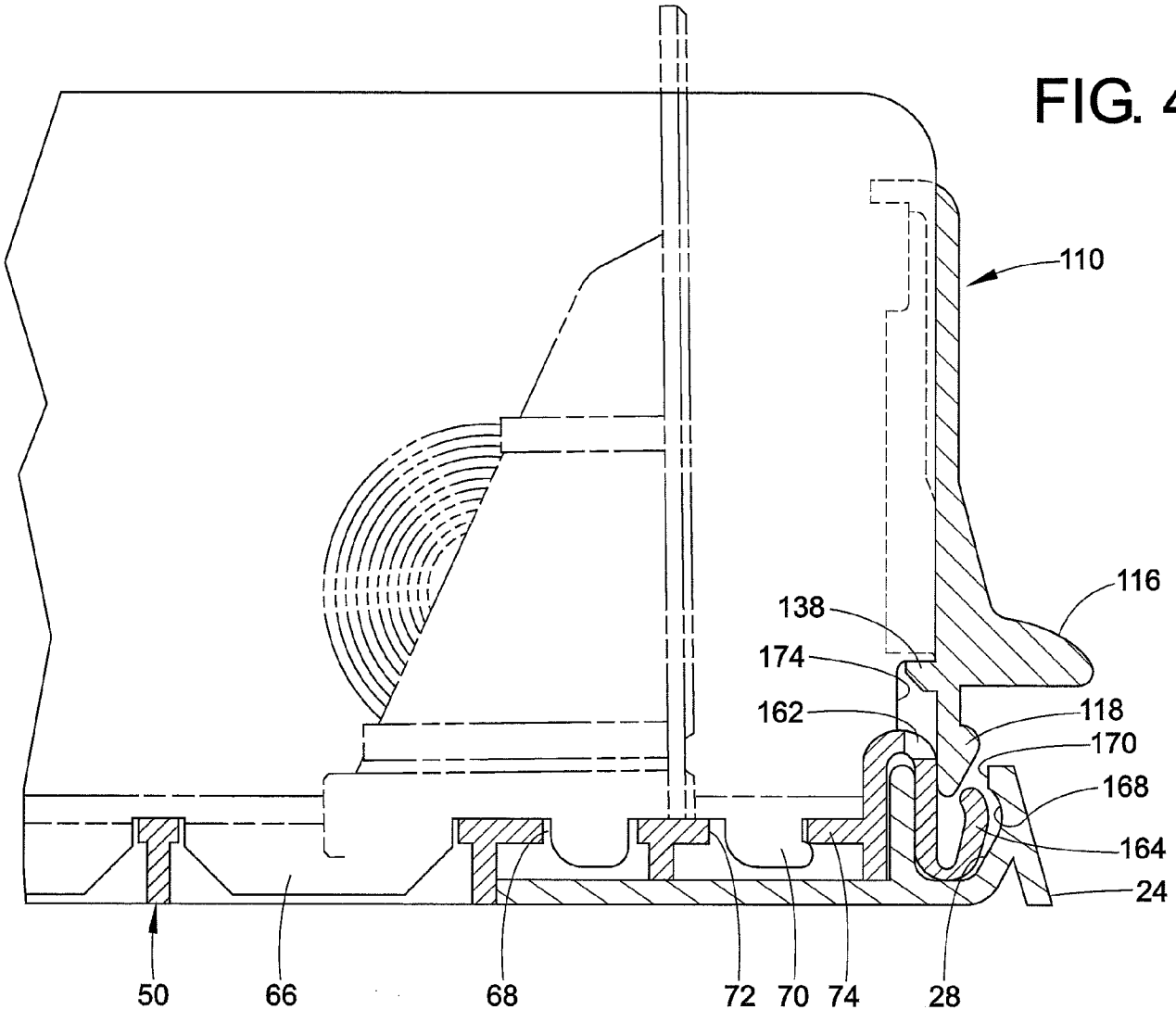
FIG. 4 is a greatly enlarged cross sectional view of a front portion of the cooperating member and the mounting member of FIG. 3 when the latch is in a disengaged condition.

In one embodiment, the cooperating member includes an elongated body 42 having a front end 44 and a rear end 46. It should be apparent from FIG. 2 that a longitudinal axis of the mounting member 20 is oriented generally transverse to a longitudinal axis of the elongated body 42 of the cooperating member. With reference now also to FIG. 1, the cooperating member in this embodiment comprises a base 50 and a divider 54 that can be selectively mounted on or secured to the base. The divider 54 can comprise a top wall 56, a bottom wall 58, a rear wall 60 and a front wall 62. Depending from the bottom wall 58 are a plurality of aligned spaced teeth or fins 66 which can be separated from each other by slots or apertures 68. Also depending from the bottom wall 58 is at least one locking tooth 70. With reference now also to FIG. 4, the locking tooth 70 can include a protrusion which cooperates with a flange 74 defined on the base 50.

In one embodiment, one or more slots are defined on the base in order to accommodate the several teeth or fins 66 and the at least one locking tooth 70, depending from the bottom wall 58 of the divider 54. It should be apparent that the one or more slots can extend generally vertically through the body from a top face thereof to a bottom face thereof. It should be apparent that the one or more slots, just like the several teeth or fins 66 can extend along the longitudinal axis of the base and the divider respectively. Further information concerning the locking feature can be found in U.S. Pat. No. 8,752,717 issued on Jun. 17, 2014, the subject matter of that patent is incorporated hereinto by reference in its entirety. Thus, a locking feature can be provided for selectively securing the divider 54 to the base 50. Due to the resiliency of the thermoplastic material from which at least one of the divider 54 and the base 50 are made, the divider can be selectively separated from the base and be selectively connected thereto any desired number of times within reason. If desired, a snap fit can be provided between the base 50 and the divider 54.

It should be appreciated that there are also other types of connecting structures which can selectively connect a base and a divider to each other, but which allow the base to be separated from the divider when the divider is not needed. This can occur when a cooperating member is meant to accommodate a wide package or product, so that a plurality of pushers may be required in order to urge the product forward in a column on a shelf. While a detachable divider 54 has been discussed in the illustrated embodiment, it should be appreciated that a base and divider assembly which is unitary or of one piece can also be employed instead.

Mounted on the front wall 62 of the divider 54 is an engaging portion which can be in the form of a laterally extending support section or flange or shoulder section 80. Extending from a side surface of the divider 54 is a support flange 86 which can be employed for supporting a side edge of a column of merchandise. Further information concerning the purpose of the support flange 86 as well as the selectively connectible and detachable nature of a divider can be found in U.S. Pat. No. 8,752,717 as mentioned above.

Figure 3:
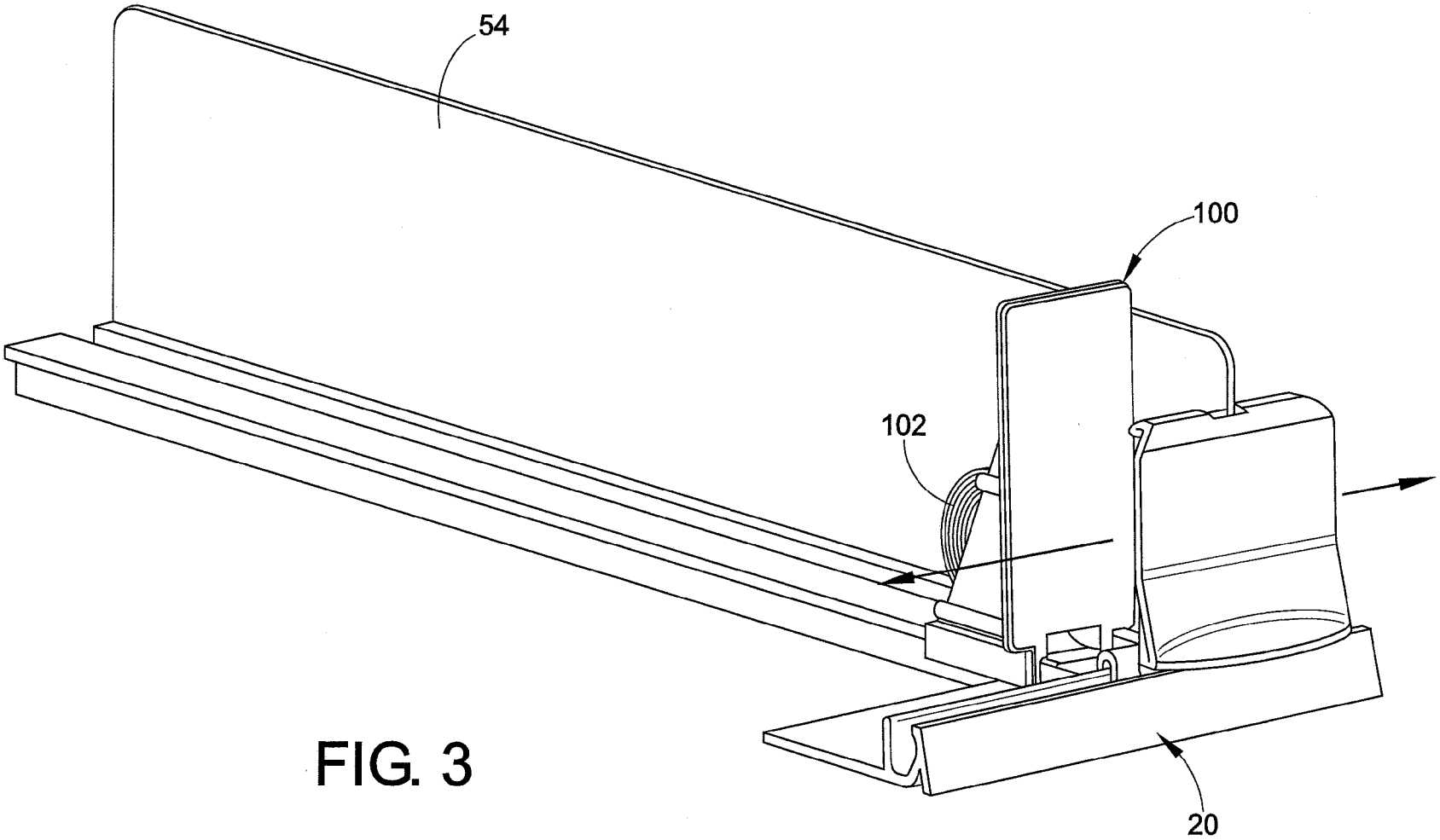
FIG. 3 is an assembled view of the merchandising system of FIG. 2 shown on a reduced scale illustrating permissible lateral movement of the cooperating member in relation to the mounting member when a latch that selectively secures the cooperating member to the mounting member is in a disengaged condition.

Located on a top surface 90 of the cooperating member can be first and second spaced rails 92 and 94. These slidably accommodate a pusher 100 which is mounted on the rails. The pusher 100 is urged forwardly on the rails by a coil spring 102, as illustrated in FIG. 3. The coil spring 102 can have a front end mounted adjacent a front end 44 of the base and a coiled rear portion thereof which is supported on the pusher 100. The operation of a coil spring to urge a pusher assembly forward on a track is well known in the art.

Figure 9B:
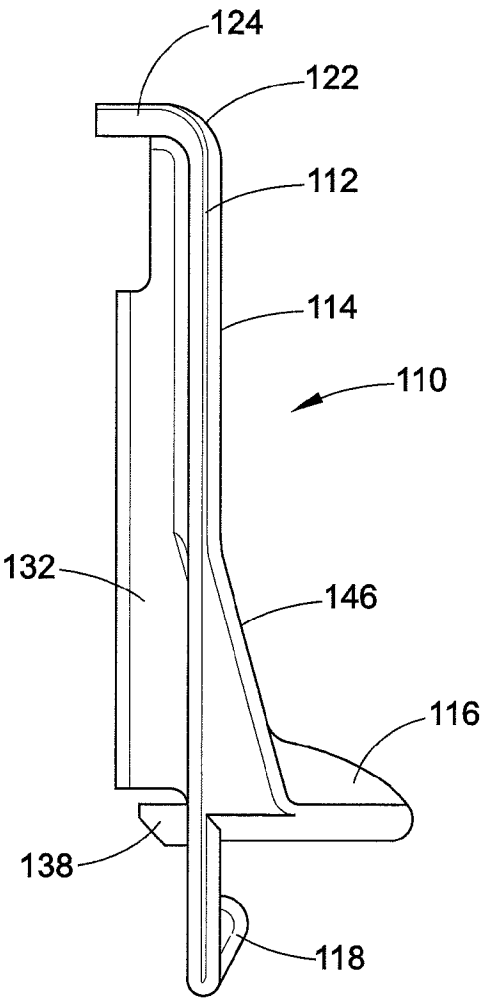
FIG. 9B is a side elevational view of the latch of FIG. 9A.
Figure 9A:
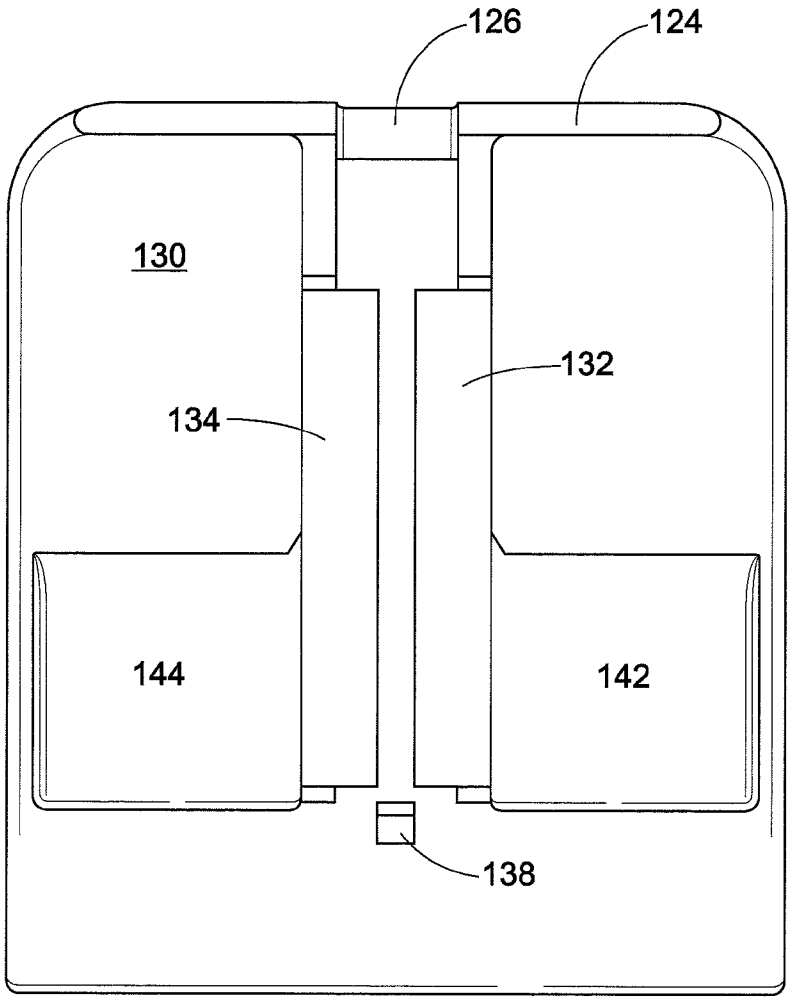
FIG. 9A is a greatly enlarged rear elevational view of the latch of FIG. 4.

With reference now to FIGS. 9A and 9B, a latch element or member 110 can be mounted to the divider. In one embodiment, the latch includes a body 112 which can be generally planar and comprises a front face 114 from which extends a gripping portion or handle 116, as well as a protrusion 118. In one embodiment, the protrusion 118 is spaced from the handle 116, with the protrusion being located beneath the handle. An upper end 122 of the latch 110 includes a top flange 124. A slot 126 can be defined in the top flange 124, as best shown in FIG. 9A. The slot can be located approximately equidistant between the two side edges of the latch, if so desired. As is evident from, e.g. FIG. 2, the slot 126 in the flange 124 accommodates the front wall 62 of the divider 54.

A rear face 130 of the latch can include first and second spaced guides 132 and 134 that can each be in the form of an L-shaped member. As is illustrated in FIG. 9A, the guides 132 and 134 can be elongated, if so desired. Disposed beneath the first and second guides 132 and 134 is a stop member 138. In this embodiment, the stop member 138 is shown as being in the form of a tooth or protrusion. In the embodiment illustrated, the handle 116 protrudes forwardly from the front face 114, whereas the stop member 138 protrudes rearwardly therefrom. Thus, the handle 116 and the stop member 138 can extend approximately normal to a plane of the front face 114. As can also be seen in FIG. 9B, the top flange 124 can extend in a direction which is approximately normal to the plane of the front face 114. Defined in the rear face 130 of the latch 110 can be first and second indentations 142 and 144, such that the latch front face 114 has an angled or sloped portion 146 as illustrated in FIG. 9B. It should be appreciated that in order to form the latch, it can be molded from a suitable known plastic material so that the latch is unitary and of one piece.

With reference again to FIGS. 4 and 5, provided on the front end 44 of the cooperating member 40 in this embodiment is an inverted U-shaped slot 160 that is defined by a pair of spaced wall members of the base located at the front end thereof. Defined in a top portion of the front end 44 and in a central location thereof is a slot 162 which is meant to accommodate the stop member 138 of the latch 110 at one end position or condition thereof, as is evident from a comparison of FIGS. 4 and 5. In the condition or position of the merchandising system illustrated in FIG. 4, the cooperating member 40 is allowed to move laterally in relation to the mounting member 20, as best shown in FIG. 3. This occurs when the latch 110 is in an unengaged or disengaged condition, such that the latch 110 is spaced away from the mounting member 20. While the cooperating member is allowed to slide laterally in relation to the mounting member, the engagement of the cooperating member with the mounting member, via the U-shaped slot 160 accommodating the tongue 26, retards the cooperating member from moving in a direction perpendicular to the mounting member 20, if it is not lifted away therefrom. However, when the latch 110 is slid downwardly, as shown in FIG. 5, the latch engages the mounting member so as to retard any further lateral or sideways movement of the cooperating member in relation to the mounting member.

Figure 5:
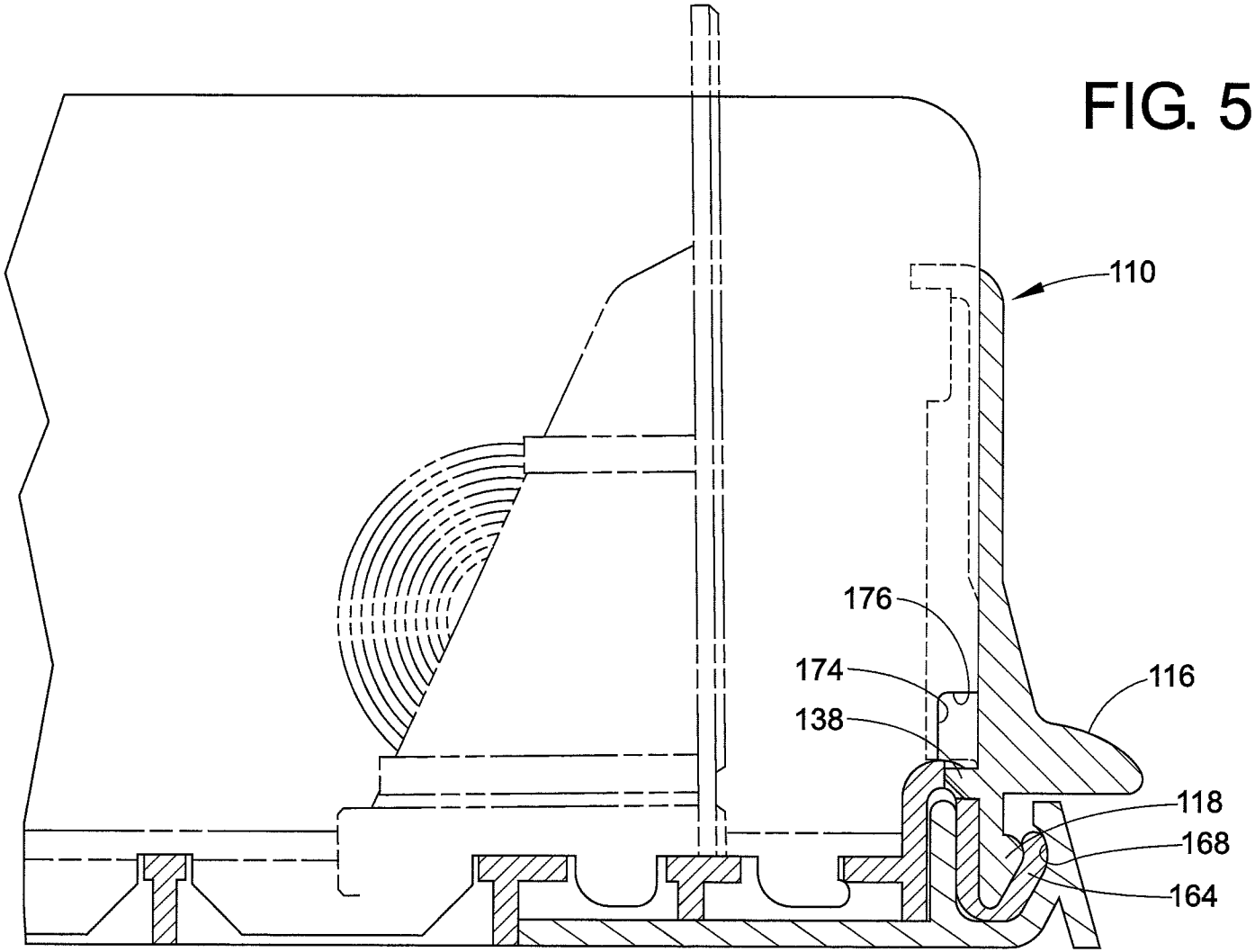
FIG. 5 illustrates the merchandising system of FIG. 4 with the latch being shown in an engaged condition.
Figure 6:
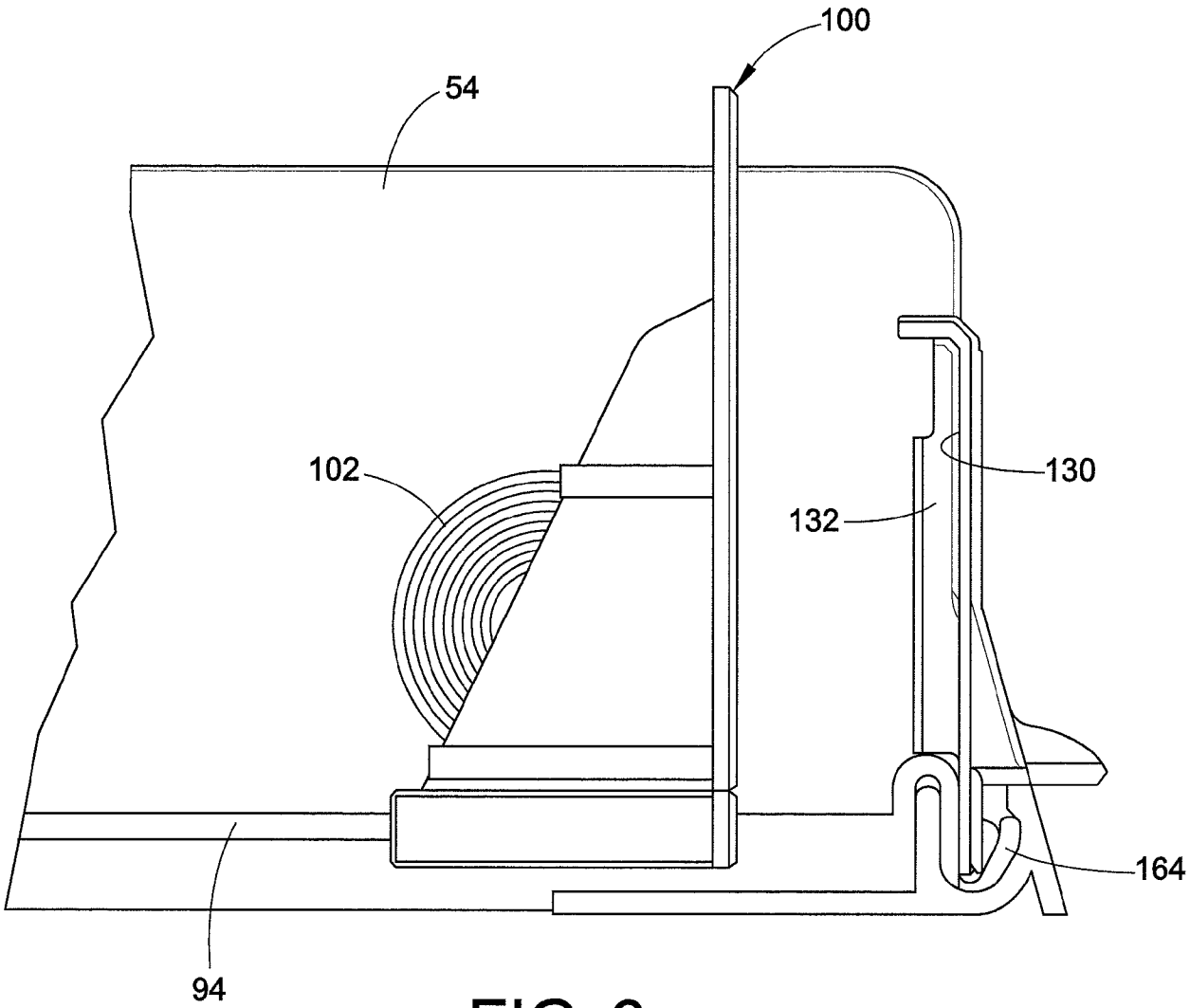
FIG. 6 is a reduced side elevational view of the merchandising system of FIG. 5.

In the orientation illustrated in FIG. 5, the protrusion 118 of the latch contacts a tongue 164 extending from the front end 44 of the cooperating member 40. The protrusion 118 urges the tongue 164 forwardly such that the tongue contacts a rear face 168 of the front wall 24 of the cooperating member. In the orientation illustrated in FIG. 5, sideward sliding motion of the cooperating member in relation to the mounting member is frictionally retarded. Movement of the latch 110, such as a linear up and down sliding movement in the embodiment illustrated herein, can be accomplished by use of various surfaces of the latch. First, the gripping portion or handle 116 can be employed to either push up or pull down on the latch 110. Second, the top flange 124 of the latch can be employed to push down on the latch.

To allow repeated flexing of the tongue 164 as the latch 110 is moved, it should be appreciated that the cooperating member can be made from a suitable resilient material, such as a variety of known thermoplastics. Similarly, the mounting member 20 can be made from a suitable thermoplastic material, as some flexure of the mounting member may also be necessary in this embodiment. Thus, all of the components of the merchandising system, namely, the latch 110, the cooperating member 40, and the mounting member 20, can be made from suitable known materials such as a variety of known thermoplastics or other resilient materials.

The limits of movement of the latch 110 can be regulated by the stop member 138 and how it interacts with the cooperating member 40. More particularly, as is illustrated in FIGS. 4 and 5, defined in the front wall 62 of the divider is a slot 174 having an upper end wall 176. As is evident from FIG. 4, the upper end wall 176 is contacted by the stop member 138 when the latch is in one end position, such that it is disengaged from the mounting member or front rail 20. As shown in FIG. 5, in the other end position of the latch 110, when it is fully engaged with the mounting member 20, the stop member 138 fits in the opening 162 and contacts a wall of the portion of the front end of the base defining the inverted U-shaped slot. Movement of the latch 110 past these end positions is, thus, prevented or at least retarded.

It should also be apparent from FIG. 5 that a bottom surface of the handle or gripping portion 116 can also be adapted to contact a top surface of the mounting member front wall 24. Such contact can also serve to limit the downward sliding movement of the latch 110 in relation to the mounting member 20. While one specific design of a latch has been illustrated herein, it should be appreciated that other latch embodiments having different shapes are also contemplated. While a latch with a sliding action has been shown, latches that rotate from open to closed are also contemplated.

In one embodiment, the latch or latching mechanism can be mounted to the divider 54 via the engagement of the flange 80 of the divider 54 in the guides 132 and 134 of the latch 110 such that when, and if, the divider is removed from the base 50, the latch is removed as well. It should be appreciated, however, that other embodiments of a latching mechanism or locking structure are also contemplated in which the latching mechanism remains on the cooperating member even after a divider is removed from a base. Also, it should be appreciated that, if the latch is attached to or mounted on the divider, other connecting structures for mounting the latch 110 to the divider 54 are also contemplated.

Figure 7:
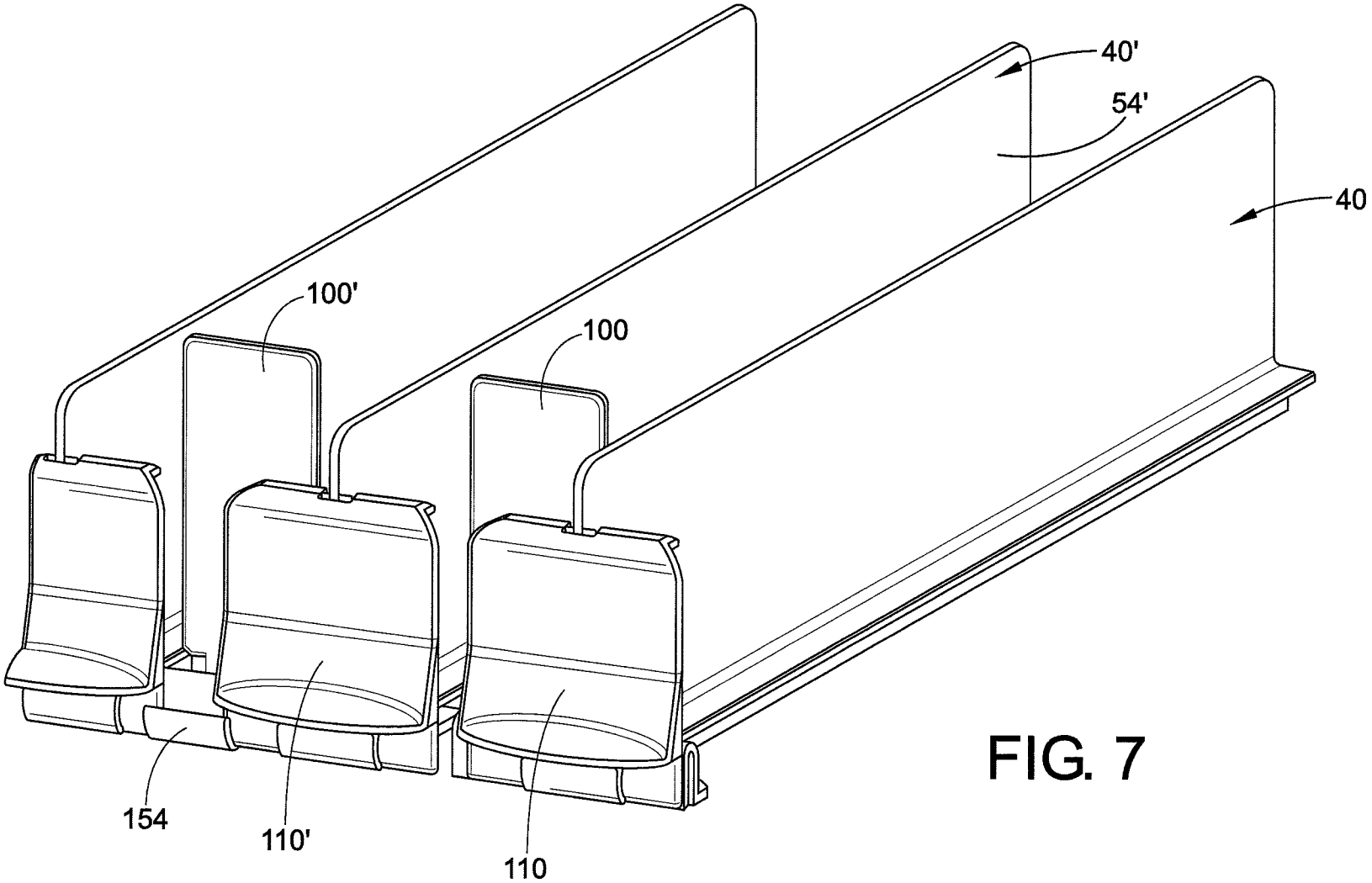
FIG. 7 is a perspective view of a merchandising system according to another embodiment of the present disclosure including several cooperating members located in a side by side relationship as they would be when mounted on a subjacent shelf (not shown) with an elongated mounting member absent for the sake of simplicity, and illustrating the use of a drop in track positioned between two cooperating members.
Figure 8:
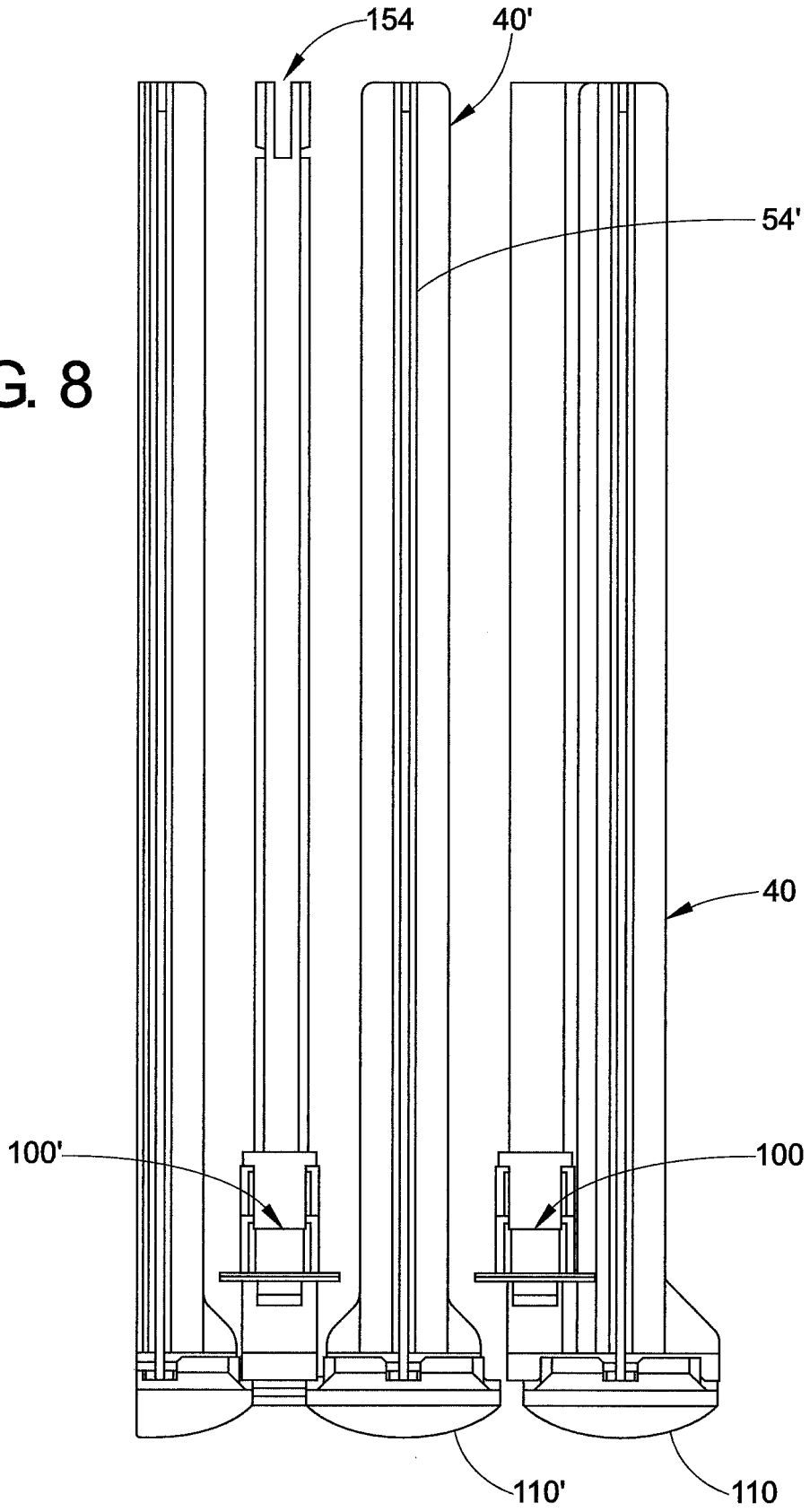
FIG. 8 is a top plan view of the merchandising system of FIG. 7.

As illustrated in FIGS. 7 and 8, a plurality of cooperating members 40 can be located on a shelf in a spaced side-by-side manner so as to allow multiple columns of merchandise to be urged forwardly on a shelf. Moreover, one or more drop in tracks 154 can also be provided. It should be evident from FIG. 8, that cooperating members can include a type which comprises a base on which are defined rails for accommodating a pusher 100. On the other hand, cooperating members, such as at 40' can include types which only comprise a divider portion 54' and do not also include a track located on a base. Disposed between such cooperating members can be one or more drop in tracks 154. Such tracks do not include a divider, but merely include a pusher assembly 100'. The drop in tracks do not have a latching mechanism of the type illustrated for the cooperating member 40 in FIGS. 1-6 and 9A and 9B. Of course, such drop in tracks could include another form of a latching mechanism or structure if so desired. On the other hand, the cooperating member 40' does include such a latching mechanism 110'.

Figure 10:
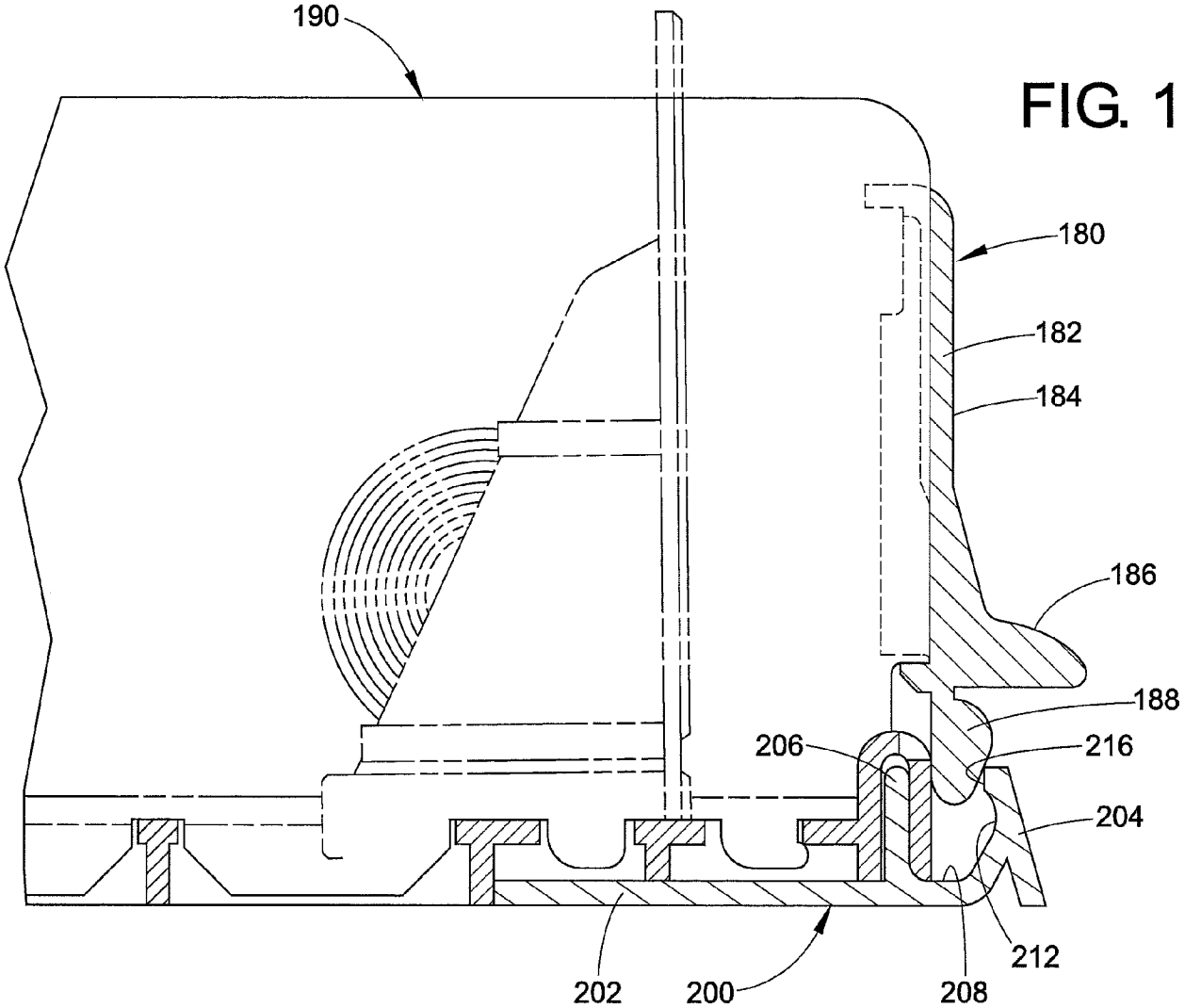
FIG. 10 is a side elevational view in cross section of a front portion of a cooperating member and a mounting member of a merchandising system according to still another embodiment of the present disclosure showing a latch in a disengaged condition.

With reference now to FIG. 10, another embodiment of a merchandising system according to the present disclosure is there illustrated. In this embodiment, a latch 180 comprises a body 182, including a front face 184 defined on which, and extending away from which, is a gripping portion or handle 186, as well as a protrusion 188. The latch 180 selectively engages a mounting member 200 comprising a base 202, a front wall 204, a tongue 206 spaced from the front wall and a slot 208 defined between the tongue 206 and the front wall 204. The slot 208 has an enlarged central area defined between a rear face 212 of the front wall and front face of the tongue 206. More particularly, it should be appreciated that the front wall rear face is somewhat indented. Thus, an upper end 216 of the slot 208 is of a smaller width than is a central portion of the slot.

Figure 11:
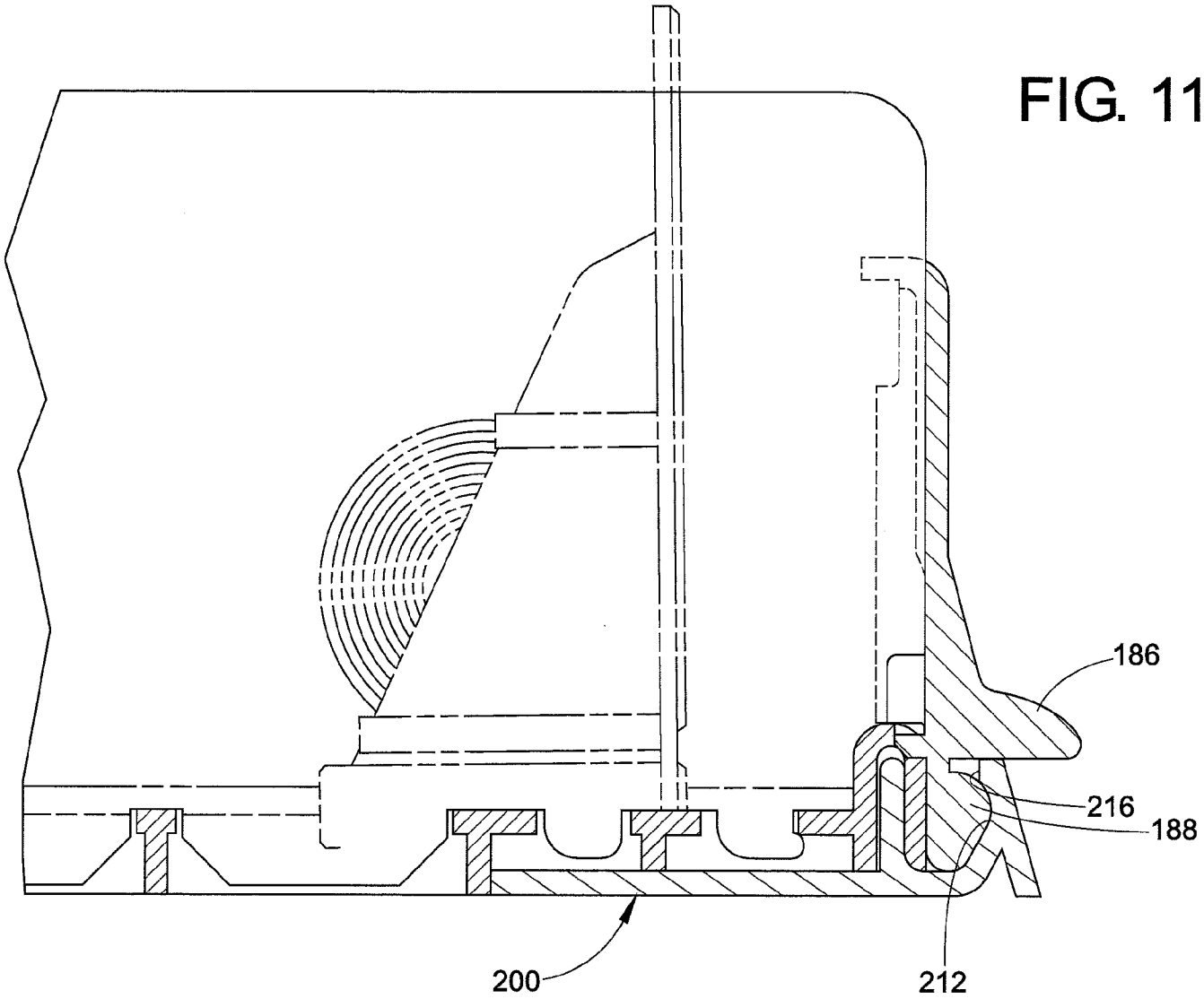
FIG. 11 illustrates the merchandising system of FIG. 10 with the latch in an engaged condition; and, FIG. 12 is an exploded perspective view illustrating a cooperating member, a mounting member and a drop in track with the drop in track being shown in various positions in relation to the mounting member.

In this embodiment, the protrusion 188 selectively enters the slot 208 when the latch 180 is pushed downwardly, such as via the handle or gripping portion 186. In this embodiment, at least one of the mounting member 200 and the latch 180 is made from a suitable known resilient material (such as a thermoplastic) which allows a certain amount of flexure of at least one of the latch and the mounting member. For example, both the latch 180 and the mounting member 200 can be made from somewhat flexible thermoplastic materials, allowing the protrusion 188 to slide past the narrowed opening or throat 216 of the slot and then snap into the slot 208 and engage the rear face 212 of the mounting member front wall 204. The engagement can be a frictional engagement so as to retard any sidewards or lateral sliding movement of the cooperating member 190 in relation to the mounting member 200, as shown in FIG. 11.

Figure 12:
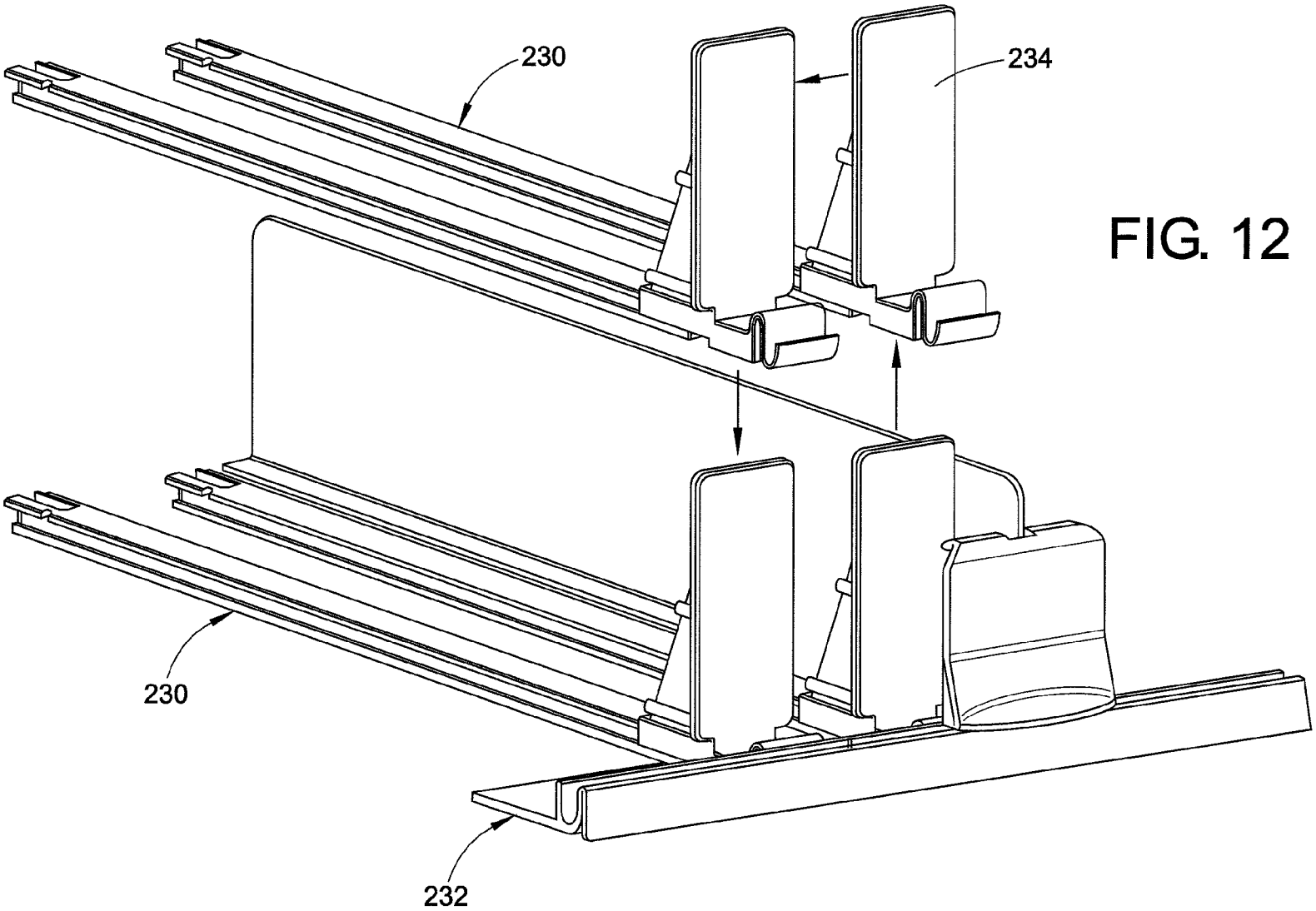

Finally, with reference to FIG. 12, illustrated there is one method for moving or selectively engaging and disengaging a drop in track 230 from a mounting member 232. It should be apparent that the track 230 is provided with a pusher 234. However, this embodiment of the track does not include a divider.

It should be appreciated that other types of latches are also contemplated for selectively engaging an elongated mounting member with a cooperating member so as to retard a lateral movement of the cooperating member in relation to the mounting member when the latch is engaged. For example, the latch could be provided or located on the mounting member, instead of being provided on the cooperating member. Also, it should be appreciated that a latch could be provided on a cooperating member comprising a drop in track or other merchandising system component, so as to selectively retard a lateral movement of such merchandising system component in relation to the mounting member.

The disclosure has been described with reference to several embodiments. Obviously, modifications and alterations will occur to others upon a reading and understanding of the preceding detailed description. It is intended that the instant disclosure be construed as including all such modifications and alterations insofar as they come within the scope of the appended claims or the equivalents thereof.

The invention claimed is:

1. A merchandising system comprising:

an elongated mounting member including a base, a front wall extending from the base, a back wall extending from the base, and a slot defined between the front wall and the back wall;

a cooperating member including a base and a divider portion, said divider portion protruding from the base, wherein said cooperating member is adapted to engage the mounting member; and a latch member slidably mounted on said divider portion, the latch member being oriented in a plane extending perpendicular to a plane of said divider portion and, said latch member including a protrusion adapted to selectively enter the slot defined in said mounting member.

2. The merchandising system of claim 1, wherein said cooperating member includes a tongue extending from a front end of the cooperating member.

3. The merchandising system of claim 2, wherein said protrusion selectively engages said tongue so as to urge the tongue into contact with a rear face of said mounting member front wall thereby retarding a lateral movement of said cooperating member in relation to said mounting member.

4. The merchandising system of claim 1, wherein said latch member includes a stop member adapted for contacting a portion of said cooperating member.

5. The merchandising system of claim 1, wherein the cooperating member divider portion is selectively detachable from the base of the cooperating member.

6. The merchandising system of claim 1, wherein said latch member includes an engaging portion which cooperates with a laterally extending flange of said divider portion.

7. The merchandising system of claim 1, further comprising a plurality of additional cooperating members, which are spaced from each other, are oriented generally parallel to each other, and are received on said mounting member.

8. The merchandising system of claim 1, wherein the latch member includes a planar body and a gripping portion protruding away from the planar body.

9. A merchandising system comprising:

an elongated mounting member including a longitudinal axis, said elongated mounting member including a front wall, a back wall, and a slot defined between the front wall and the back wall;

a cooperating member including an elongated body which is oriented in a direction generally transverse to said mounting member longitudinal axis, said cooperating member including a base, a divider protruding from the base and a front end portion received in the slot of said mounting member, and a latch member slidably mounted to said divider of said cooperating member, said latch member being adapted to slide along an axis oriented transverse to a longitudinal axis of the cooperating member and including a protrusion adapted to selectively enter the slot of said elongated mounting member so as to retard a lateral movement of said cooperating member in relation to said mounting member;

wherein when the protrusion is not located in the slot, a lateral movement of said cooperating member is permitted in relation to said mounting member.

10. The merchandising system of claim 9, wherein at least one of said elongated mounting member and said latch member is made from a resilient material.

11. The merchandising system of claim 9, wherein said latch member includes a planar body comprising a front face which includes a gripping portion adapted for manual contact.

12. The merchandising system of claim 9, wherein said latch member includes a top flange adapted for manual contact.

13. The merchandising system of claim 9, further comprising a plurality of additional cooperating members, which are spaced apart from each other, and which are received on said elongated mounting member.

14. The merchandising system of claim 9, wherein said cooperating member further comprises a track.

15. A merchandising system comprising:

an elongated mounting member;

a cooperating member including a base portion extending along a horizontal plane and a divider portion, said divider portion protruding from the base portion and extending along a vertical plane, wherein a front end of the base portion is adapted to cooperate with the mounting member;

a front wall mounted to said divider portion, the front wall being adapted to slide along a vertical axis oriented perpendicular to the horizontal plane of the base portion of the cooperating member;

wherein said front wall includes an engaging portion comprising at least one L-shaped guide extending parallel to a longitudinal axis of the front wall which engaging portion cooperates with a protrusion located at a front end of said cooperating member divider portion wherein the protrusion extends laterally away from both a first and a second side of the divider portion; and wherein said front wall includes a protrusion extending away from a lower end of said front wall, the protrusion adapted to enter a slot defined in the mounting member.

16. The merchandising system of claim 15, wherein said front wall includes a generally planar body and a gripping portion extending away from the body.

17. The merchandising system of claim 15 wherein the front wall further comprises a stop member adapted for contacting a portion of the cooperating member to limit a sliding movement of the front wall in relation to the cooperating member.

18. The merchandising system of claim 15 wherein the front wall further comprises a top flange adapted for manual contact.

* * * * *